US006679549B2

(12) United States Patent
Catelli

(10) Patent No.: US 6,679,549 B2
(45) Date of Patent: Jan. 20, 2004

(54) TABLE SEAT WITH EASY AND SECURE POSITIONING

(75) Inventor: Pietro Catelli, Como (IT)

(73) Assignee: Artsana SPA, Grandate (IT)

( * ) Notice: Subject to any disclaimer, the term of this patent is extended or adjusted under 35 U.S.C. 154(b) by 0 days.

(21) Appl. No.: 10/309,142

(22) Filed: Dec. 4, 2002

(65) Prior Publication Data

US 2003/0122408 A1 Jul. 3, 2003

(30) Foreign Application Priority Data

Dec. 5, 2001 (IT) ..... MI20010635 U

(51) Int. Cl.[7] ..... A47B 39/00
(52) U.S. Cl. ..... 297/174 CS
(58) Field of Search ..... 297/174 CS, 130, 297/134, 217.1

(56) References Cited

U.S. PATENT DOCUMENTS 4,506,928 A 3/1985 Marion
4,530,539 A * 7/1985 Gaber et al. ..... 297/174 CS
4,586,746 A 5/1986 Day et al.
5,480,211 A * 1/1996 Douglas et al. ..... 297/174 CS
6,273,503 B1 8/2001 Cheng

FOREIGN PATENT DOCUMENTS

DE 846778 * 2/1951 ..... 297/174
DE G 94 00 302.5 U1 3/1994
GB 2 068 716 8/1981

* cited by examiner

*Primary Examiner*—Peter R. Brown
(74) *Attorney, Agent, or Firm*—Young & Thompson

(57) ABSTRACT

A table seat comprises a foldable frame (1A) supporting an at least partly foldable housing (2) for receiving a child, said frame (1A) comprising opposing lateral portions (3) for its securing to the top (5) of the table (6), each portion (3) presenting, superposed, an upper first arm (10) and a lower second arm (11), the second arm (11) comprising a tubular structure (15) bent at its free end (16) and supporting a movable projecting intermediate portion (17), said portion (17) and the bent end (16) being intended to cooperate with the underside (at 8) of the top (5) of the table (6). The intermediate portion (17) of the second arm (11) comprises a first hollow tubular element (23) movable along its longitudinal axis (K) relative to the tubular structure (15), said first element (23) containing a second coaxial element (25) movable longitudinally independently of the first (23), but manipulable jointly with it.

12 Claims, 5 Drawing Sheets

TABLE SEAT WITH EASY AND SECURE POSITIONING

FIELD OF THE INVENTION

BACKGROUND OF THE INVENTION

The present invention relates to a table seat in accordance with the introduction to the main claim.

A table seat is known to comprise a foldable frame to be fixed to the top of the table at its edge. For this purpose, the frame (supporting an at least partly foldable housing for containing a child) comprises connection portions disposed parallel to each other along the sides of the seat. Each portion comprises a first and a second arm, to be positioned on opposite sides of the table top respectively. Specifically, the second arm, located below the first and intended to be positioned on the underside of said table top, comprises a tubular structure bent at one end, this latter being intended to make contact with the table top. In order to provide greater stability to the table seat, an intermediate portion is often present projecting from the lower arm, this portion also being intended to cooperate with said table top in a position distant from the bent end. To enable correct positioning of the seat at the table edge, each intermediate portion comprises a part movable relative to the structure of the corresponding second arm and intended to make contact with the table top; this mobility is achieved by a generally screw-type manipulation arrangement for said part and enables the seat to be fixed rigidly and securely to the table. The movable part of the intermediate portion can hence assume a plurality of positions spaced from the tubular structure of the second arm starting from a fixed position of minimum separation from this structure.

Such a known seat presents the drawback of a predetermined limited gap between the first arm of each connection portion and the upper end of the intermediate portion projecting from the second arm. This means that even when in its position of minimum separation from the tubular structure of the second arm, the end of said intermediate portion is still distant from said structure and projects towards the first arm. Consequently, such a seat cannot be connected to tables having a shoulder of relatively large height situated below the table top to which the seat is to be applied. Hence, the known arrangement is not applicable to the top of any table, but only to those tops having a limited thickness (less than the distance between each upper arm of the seat connection portions and the upper side of the intermediate portion projecting from the second arm) and/or not presenting a lower shoulder close to their edge.

Moreover, a seat of the aforestated type can become detached from the table top when the child exerts a thrust along an axis distant from but perpendicular to said top, in a direction striking the lower surface thereof. This can happen, for example, when the child rests its feet on a surface, for example of a chair, positioned below the seat and the child pushes against the surface with its feet.

SUMMARY OF THE INVENTION

An object of the present invention is therefore to provide a table seat which can be applied to the top of any table.

Another object is to provide a seat of the aforestated type which is reliable and safe in use and which can withstand the stresses generated by a child along an axis distant from but perpendicular to the table top without becoming detached therefrom.

These and other objects which will be apparent to the expert of the art are attained by a table seat in accordance with the accompanying claims.

BRIEF DESCRIPTION OF THE DRAWINGS

The present invention will be better understood from the accompanying drawing, which is provided by way of non-limiting example and in which.

DETAILED DESCRIPTION OF THE INVENTION

Figure 1:
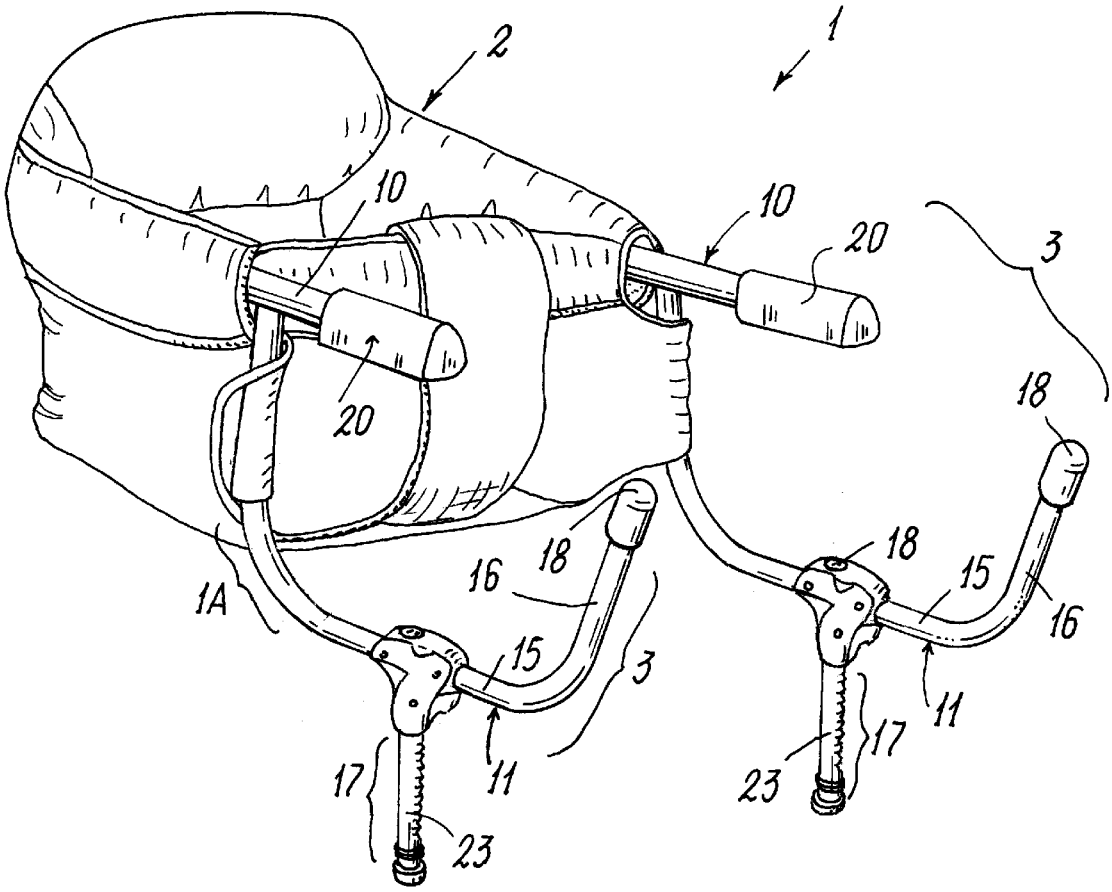
FIG. 1 is a front perspective view of a table seat according to the present invention.
Figure 2:
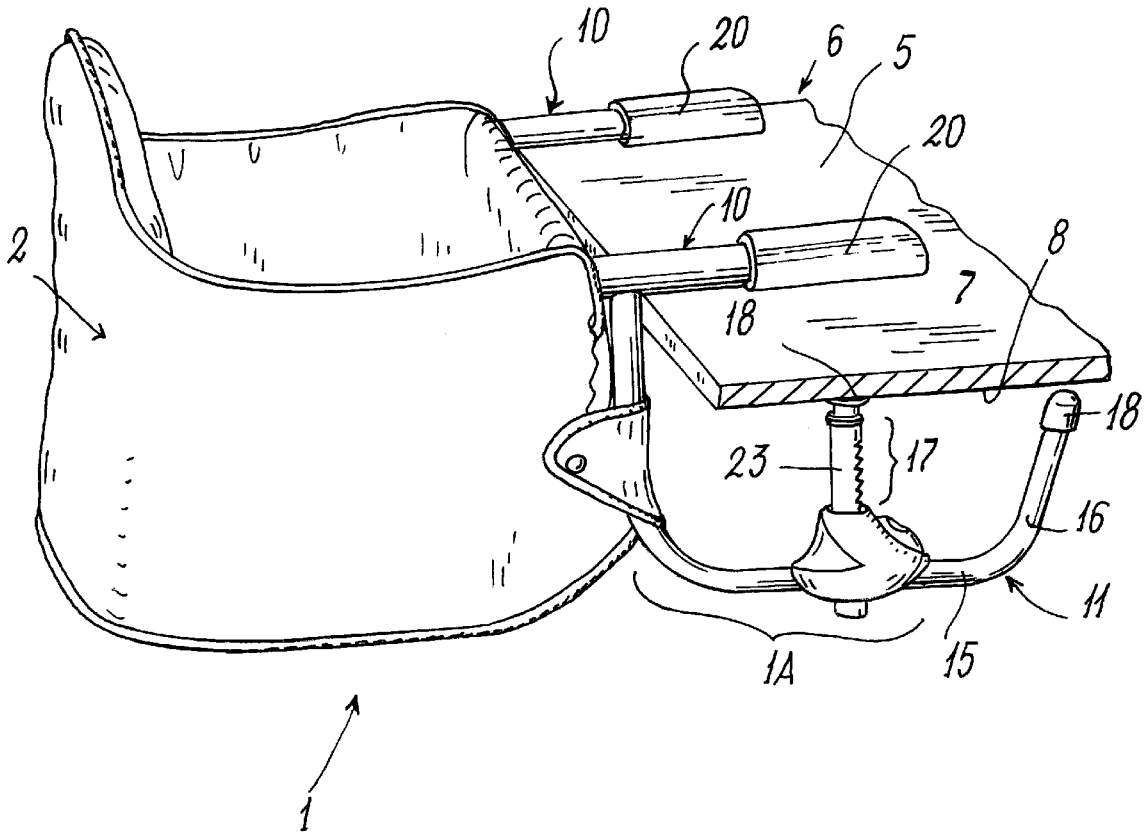
FIG. 2 is a side perspective view of the seat of FIG. 1 applied to a table.

With reference to said figures, a table seat is indicated overall by 1 and comprises a foldable frame 1A and a housing 2, also partly foldable, intended to support a child. The frame 1A comprises lateral portions 3 enabling the seat to be connected to the top 5 of a table 6, said top presenting an upper surface 7 and a lower surface 8.

Each lateral portion comprises an upper first arm 10 and a lower second arm 11, the first intended to be positioned on the surface 7 of said top 5 and the second to be positioned against the surface 8 thereof. Both the arms are of tubular structure. Specifically, the second arm 11 comprises a tubular structure 15 presenting a free end 16 and supporting an intermediate portion 17; this latter and said end 16 comprise terminal portions 18 of high friction coefficient material able to contact the surface 8 of the top 5 such as to prevent mutual slippage. A similar terminal portion 20 is present on the first arm 10 of each lateral seat portion 3 intended to make contact with the surface 7 of the top 5 of the table 6.

According to the invention, the intermediate portion 17 of the second arm 11 of each lateral portion 3 is movable relative to the tubular structure of said arm and comprises a first tubular element 23, hollow internally at 24, and containing a second tubular element 25. The two elements 23 and 25 are mutually rigid in each axial movement of the portion 17 along its longitudinal axis K (coinciding with that of each element 23 and 25), but are torsionally free in the sense the element 25 can be rotated independently of the element 23 which contains it. For this purpose, the element 25 is hollow internally at 26 and presents a threaded portion 27 provided in the wall of the internal cavity. This thread is arranged to cooperate with a threaded end 28 of a pin 30 inserted into the cavity 26 of the element 25 and into the cavity 24 of the element 23, said pin presenting a head 31 inserted into a seat 32 in a knob 33 positioned externally to the element 23, the head 31 being torsionally rigid with the knob 33, for example by means of a polygonal connection. The knob 33 is also connected (in any known manner) to the end 23K of the element 23 close to it in such a manner as to be able to rotate about it, but not to be able to separate from it. In this manner, by rotating the knob 33 a movement of the element 25 along the axis K is obtained, so causing it to emerge from or retract (according to the direction of rotation of the knob 33 about the axis K) into the cavity 24 of the element 23 via that end 23A thereof closer to the upper arm 10.

Figure 5:
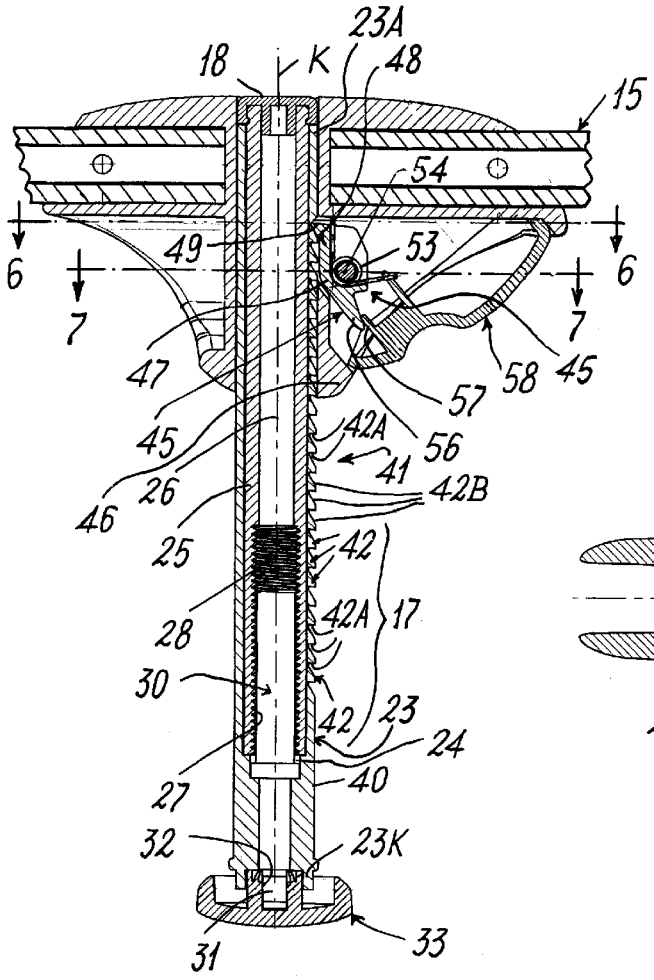
FIG. 5 is a section on the line 5—5 of FIG. 4.
Figure 9:
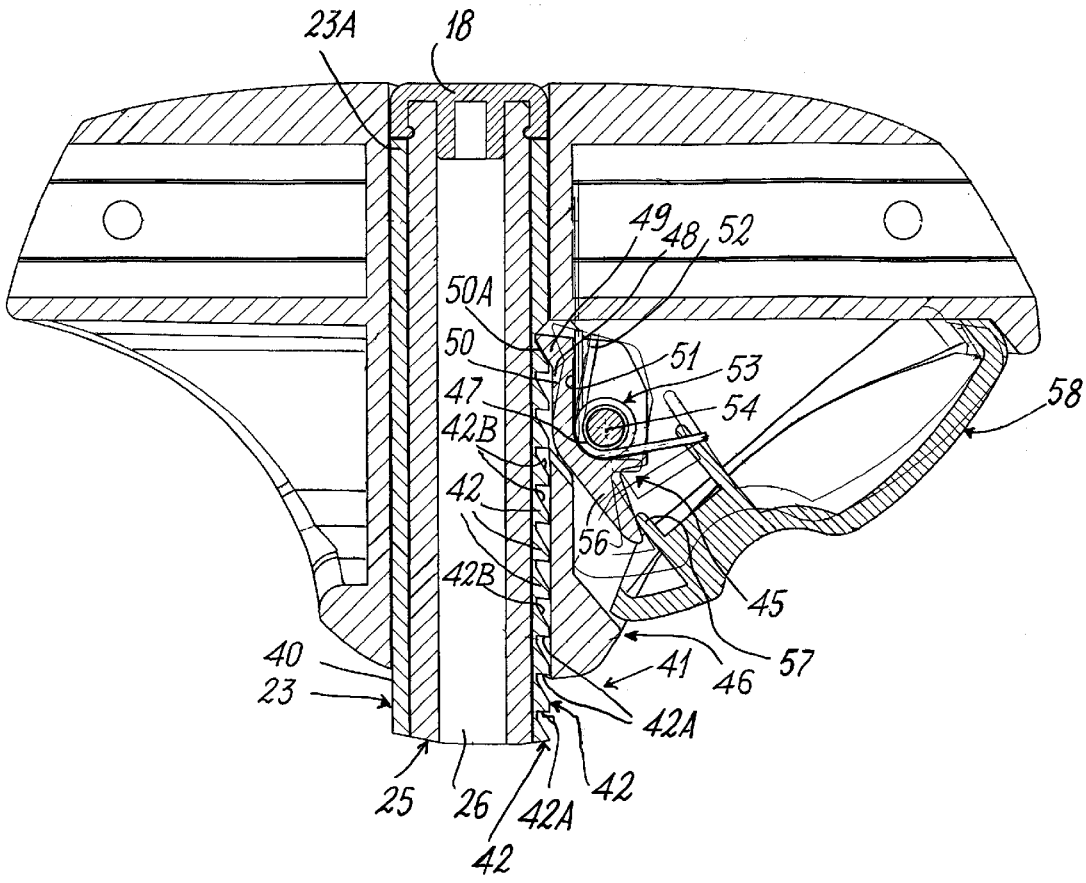
FIG. 9 is an enlarged view of a portion of the part shown in FIG. 3.

On its outer surface 40, the element 23 comprises a toothed portion 41 with teeth 42 which, in longitudinal section (see FIGS. 5 and 9), are of right-angled trapezium shape (or alternatively of right-angled triangular shape, not shown). Consequently, each tooth presents a side 42A disposed perpendicular to the said surface 40 (and defining an undercut therein) and an inclined opposing side 42B. This toothed portion 41 is arranged to cooperate with a locking member 45 able to block the movement of the element 23 along the axis K.

Figure 3:
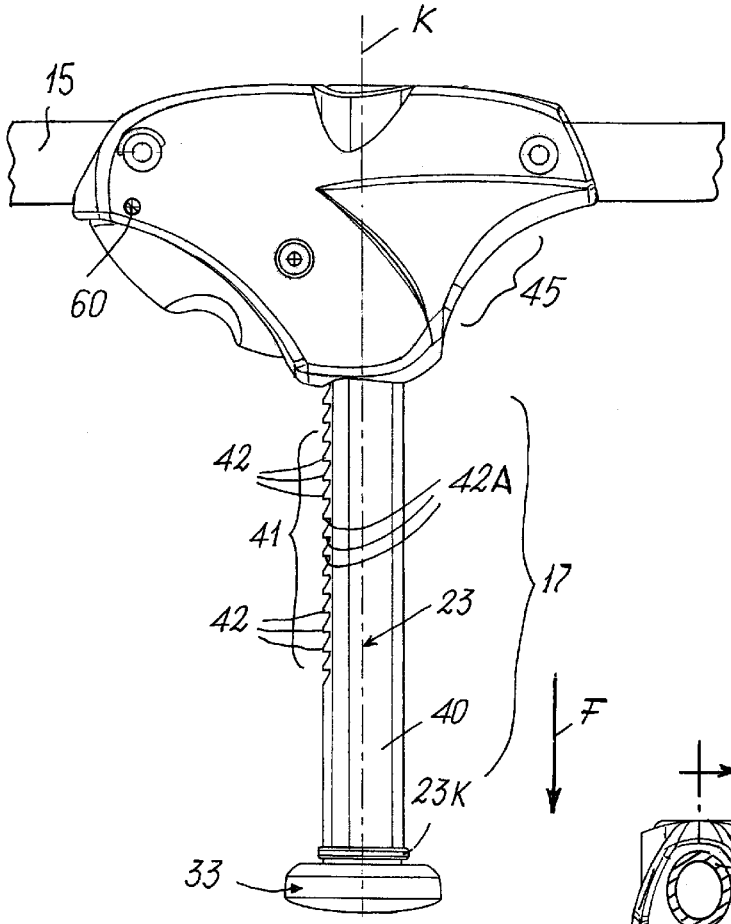
FIG. 3 is an enlarged side view of a part of the seat of FIG. 1.
Figure 4:
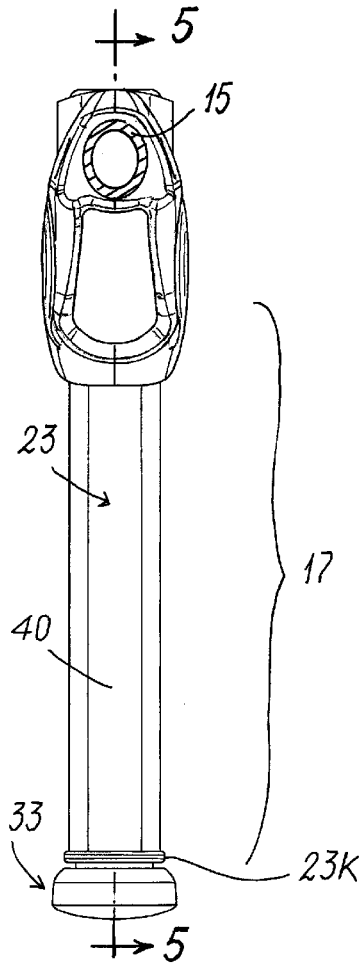
FIG. 4 is a front view of the part shown in FIG. 3.
Figure 6:
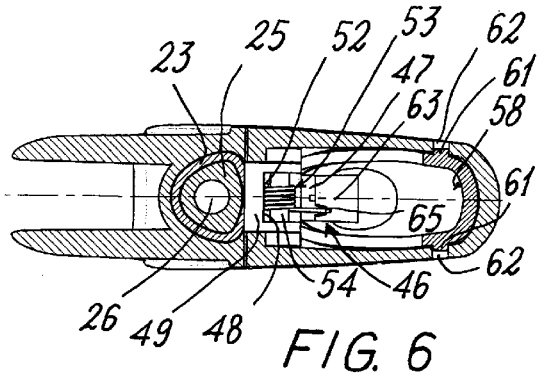
FIG. 6 is a section on the line 6—6 of FIG. 5.

Specifically, the locking member 45 is associated with a container body 46 secured to the structure 15 of each lower arm 11 and comprising (see FIGS. 6 and 9) a lever 47 presenting a first arm 48 having its end 49 bent at a right angle; on that side 50 facing the element 23 there is provided an end surface 50A inclined at an angle preferably identical to that of the side 42B of each tooth 42 of the portion 41. On the side 51 opposite the side 50 there rests an arm 52 of a helical spring 53 passing about a pin 54 on which the body 47 is pivoted. This latter presents a projecting second arm 56 able to cooperate with a projection 57 on a trigger 58 arranged to shift the body 47 when necessary in order to release the element 23 so that it moves along the axis K in a direction away from the arm 10. The trigger is pivoted (FIG. 3) at 60 to the body 46 of the locking member and moves in a guided manner within this latter by way of projections 61 movable within recesses 62 in said body (FIG. 6).

Figure 7:
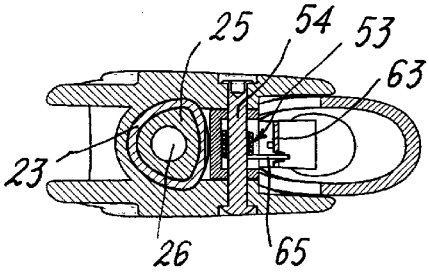
FIG. 7 is a section on the line 7—7 of FIG. 5.
Figure 8:
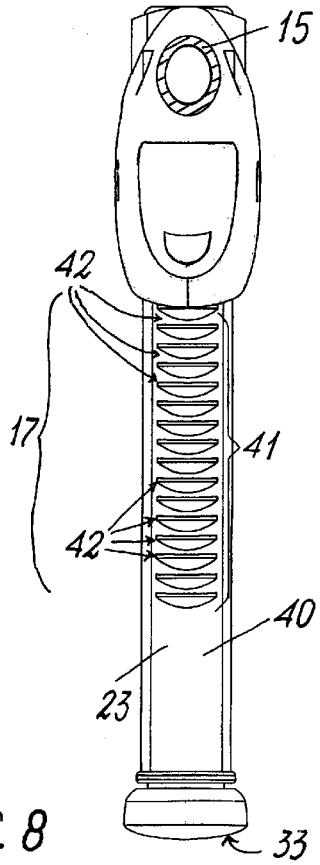
FIG. 8 is a view from the rear of the part shown in FIG. 3.

The trigger 58 also comprises a crosspiece 63 (FIG. 7) with which another arm 65 of the spring 53 is associated.

When the seat is positioned on the top 5 of the table 6, that portion 17 of the second arm 11 of each lateral portion 3 lies below the table top. To secure the seat to the table top, this portion is pushed towards the surface 8 of the top 5, said portion moving freely relative to the structure 15. This movement towards the table top 5 is free by virtue of the fact that the inclined surface 50A of the side 50 of the arm 48 of the lever 47 can slide freely along the inclined sides 42B of the teeth 42 of the portion 41 of the element 23. Having arrived in proximity to the surface 8 of the table top 5, the terminal portion 18 of each intermediate portion 17 can be clamped against said top if necessary. To achieve this the knob 33 is rotated in order to cause the element 25 to translate relative to the element 23 and bring it against said surface 8.

The position achieved is stable in that the element 23 and the associated element 25 cannot withdraw from the table top 5 because of the right-angle bent end 49 of the first arm 48 of the lever 47 in cooperation with the perpendicular side 42A of a tooth of the toothed portion 41.

To remove the seat, the trigger 58 is pressed to rotate the lever 47 about the pin 54 by the cooperation between the projection 57 and the second arm 56 of said lever. The right-angled end portion 49 hence separates from the tooth 42 with which it was engaged and the element 23 is pulled so as to detach it from the table top 5 (in accordance with the arrow F of FIG. 3) and bring that element and the element 25 into the position shown in the figures. The element 25 can be made to retract completely into the element 23 by rotating the knob.

The seat of the invention can be securely fixed to a table even if this presents shoulders along the edge of its top 5 projecting from the surface 8 thereof. This is due to the ability of the portion 17 to be moved such as to bring the terminal portion 18 substantially onto the edge of the structure 15.

Moreover, the aforedescribed seat withstands the stresses directed from the bottom upwards without separating from the table top 5.

Other embodiments can be obtained in the light of the aforegoing. For example, the locking member 46 can comprise other locking means (for example pins) arranged to cooperate with counter-means (for example holes) from the element 23 so as to halt its movement along the axis K. These embodiments are also to be considered as falling within the scope of the present document.

What is claimed is:

1. A table seat comprising a foldable frame supporting an at least partly foldable housing for receiving a child;

said frame comprising opposing lateral portions for securing to a top of a table having an underside;

each portion comprising, superposed, an upper first arm and a lower second arm;

the second arm comprising a tubular structure having a bent free end and supporting a movable projecting intermediate portion;

said bent free end and intermediate portion being structured and arranged to cooperate with the underside of the table;

wherein the intermediate portion of the second arm comprises a hollow tubular first element movable along its longitudinal axis relative to the tubular structure;

said first element containing a coaxial second element movable longitudinally along said longitudinal axis independently of the first element, but structured and arranged to be jointly manipulable with said first element;

the longitudinal movement of the first element being free in one direction, but subject to removable blocking in the opposite direction.

2. The seat according to claim 1, wherein the first element comprises a cavity which houses the second element; and said second element is operatively associated with manipulation means for moving said second element along the longitudinal axis independently of the first element.

3. The seat according to claim 2, wherein the second element is hollow and comprises a cavity in which a pin is at least partly inserted; said pin having a threaded part arranged to cooperate with a threaded portion provided in the wall of its cavity; said pin emerging from the second element and from an end of the first element distant from the first arm of the lateral portion; said pin being torsionally rigid with a manipulation member external to the second element.

4. The seat according to claim 2, wherein the second element carries at its end a resting member of high coefficient of friction; said resting member being withdrawable from that end of the first element which faces the first arm of the lateral portion.

5. The seat according to claim 2, further comprising locking means for blocking the movement of the first element in the longitudinal direction; said locking means cooperating with locking counter-means associated with the first element.

6. The seat according to claim 5, wherein the locking means are associated with the tubular structure of the second arm of the seat.

7. The seat according to claim 6, wherein the locking means comprise a container body secured to the tubular structure of the second arm; said locking means also comprising a lever having a first arm with an end bent at a right angle to cooperate with one of a plurality of undercuts provided in the surface of the first element defining the locking counter-means; said lever being pivoted on a pin associated with said container body and presenting a second arm arranged to cooperate with a manipulation member movably associated with said container body.

8. The seat according to claim 7, wherein the undercuts are defined in a toothed portion provided in the surface of the first element; the teeth of said toothed portion having one side perpendicular to said surface and one inclined opposing side.

9. The seat according to claim 8, wherein each tooth has a longitudinal section in the form of a right-angled triangle.

10. The seat according to claim 8, wherein each tooth has a longitudinal section in the form of a right-angled trapezium.

11. The seat according to claim 8, wherein the first arm of the lever has, facing the first element, a side presenting an inclined end surface able to slide freely on the inclined side of each tooth of the toothed portion of the first element.

12. The seat according to claim 7, wherein the manipulation member is a trigger member pivoted to the container body and movable in a guided manner along guides of said container body.

* * * * *